US009580855B2

(12) United States Patent
Kim

(10) Patent No.: US 9,580,855 B2
(45) Date of Patent: Feb. 28, 2017

(54) PACKING MATERIAL FOR LAUNDRY TREATMENT APPARATUS

(71) Applicant: LG ELECTRONICS INC., Seoul (KR)

(72) Inventor: Daehee Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/531,056

(22) Filed: Nov. 3, 2014

(65) Prior Publication Data

US 2015/0122680 A1 May 7, 2015

(30) Foreign Application Priority Data

Nov. 4, 2013 (KR) ..... 10-2013-0133140

(51) Int. Cl.

| | |
|---|---|
| ***B65D 85/00*** | (2006.01) |
| ***D06F 39/00*** | (2006.01) |
| ***B65D 81/02*** | (2006.01) |
| *D06F 23/04* | (2006.01) |

(52) U.S. Cl.

CPC ..... *D06F 39/001* (2013.01); *B65D 81/02* (2013.01); *B65D 2585/6855* (2013.01); *D06F 23/04* (2013.01)

(58) Field of Classification Search

CPC ..... G06F 11/1628; B65D 5/58; B65D 81/02; B65D 2585/6855; D06F 39/001; D06F 23/04

USPC ..... 206/320, 576, 521, 523, 591, 592

See application file for complete search history.

(56) References Cited

U.S. PATENT DOCUMENTS

| | | | | |
|---|---|---|---|---|
| 3,184,048 | A * | 5/1965 | Bjerum | 206/320 |
| 3,187,887 | A * | 6/1965 | Charles et al. | 206/320 |
| 3,266,444 | A * | 8/1966 | Budd | B65D 19/0028 108/51.3 |
| 3,335,849 | A * | 8/1967 | Collin | 206/320 |
| 3,812,959 | A * | 5/1974 | Brennan | 206/320 |
| 4,366,902 | A * | 1/1983 | Fanson et al. | 206/320 |
| 4,832,190 | A * | 5/1989 | Favreau | 206/320 |

(Continued)

FOREIGN PATENT DOCUMENTS

| | | |
|---|---|---|
| CN | 1048904 | 1/1991 |
| CN | 1968858 | 5/2007 |
| WO | 2011/084953 | 7/2011 |

OTHER PUBLICATIONS

Office Action issued in Chinese Application No. 201410612879.5 on Mar. 4, 2016, 11 pages (with English translation).

*Primary Examiner* — Jacob K Ackun
*Assistant Examiner* — Jenine Pagan
(74) *Attorney, Agent, or Firm* — Fish & Richardson P.C.

(57) ABSTRACT

The present invention relates to a packing material for a laundry treatment apparatus having a casing with an entrance/exit hole through which laundry is entered and exited and an outer tub hung in the casing and having an opening through which the laundry is entered and exited, the packing material including a base part at a side of a predetermined fold line corresponding to the shape of the opening and a gap compensating part at another side of the fold line, wherein the base part is inserted into a space between the outer tub and an entrance/exit hole forming part forming the entrance/exit hole in the casing, and wherein the gap compensating part is inserted into an inside of the outer tub when the packing material is folded along the fold line.

14 Claims, 5 Drawing Sheets

(56) References Cited

U.S. PATENT DOCUMENTS 5,056,341 A 10/1991 Mori et al.
5,083,845 A * 1/1992 Sparks et al. ..... 312/228

* cited by examiner

FIG. 2
FIG. 2A
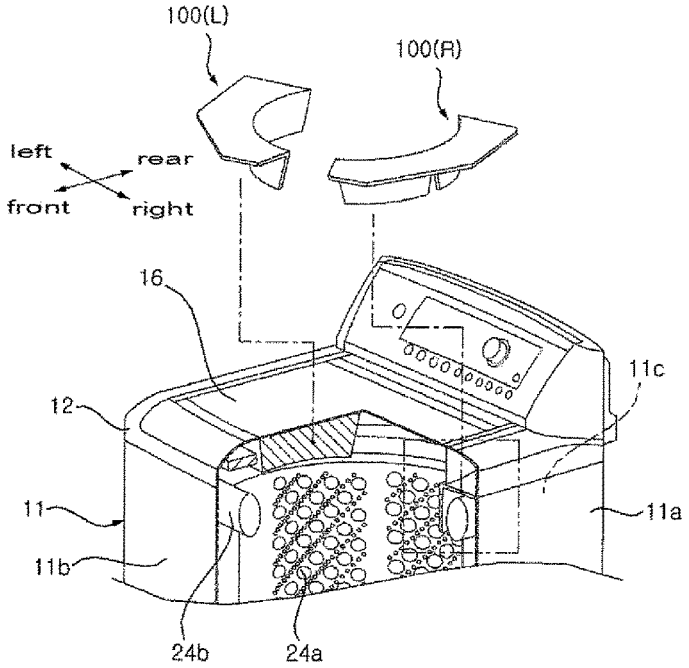
FIG. 2B
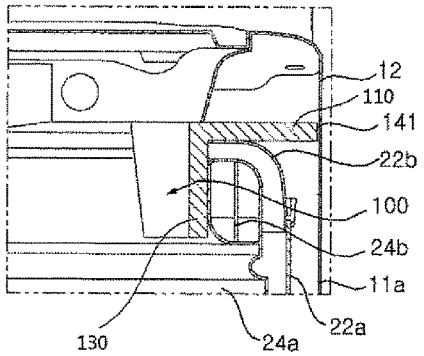

FIG. 3
FIG. 3A
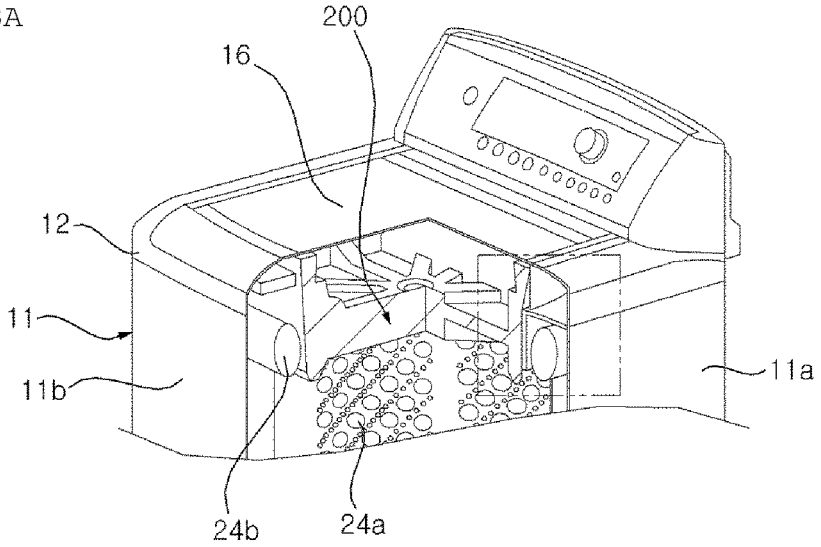
FIG. 3B
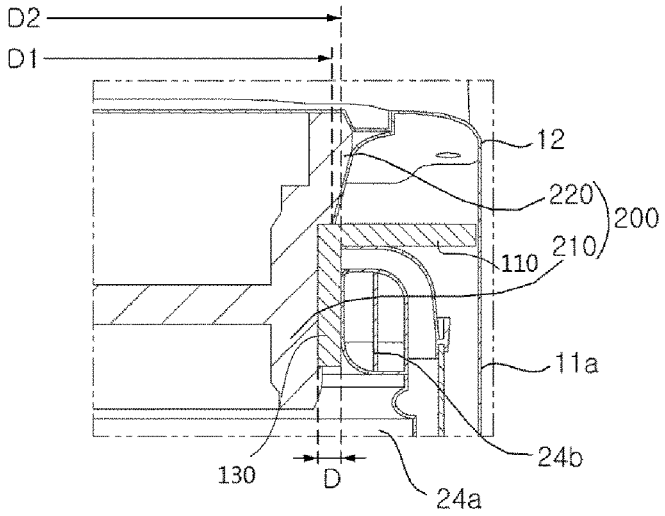

FIG. 5
FIG. 5A
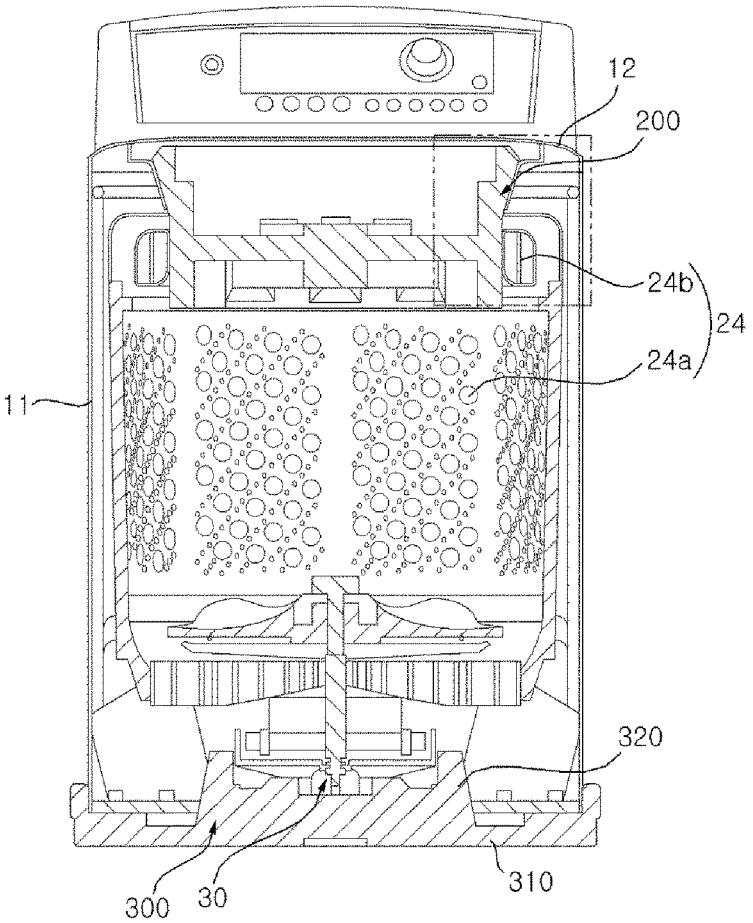
FIG. 5B
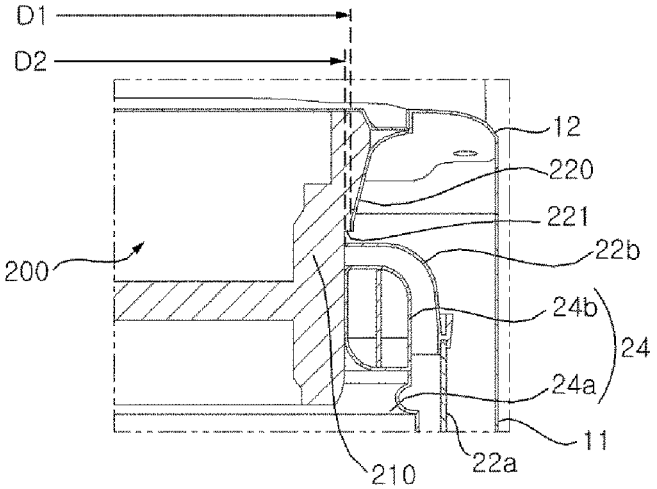

PACKING MATERIAL FOR LAUNDRY TREATMENT APPARATUS

CROSS-REFERENCE TO RELATED APPLICATION

This application claims the priority benefit of Korean Patent Application No. 10-2013-0133140, filed on Nov. 4, 2013, in the Korean Intellectual Property Office, the disclosure of which is incorporated herein by reference.

BACKGROUND OF THE INVENTION

1. Field of the Invention

The present invention relates to a material for packing a laundry treatment apparatus.

2. Description of the Related Art

Typically, a laundry treatment apparatus includes a main body having an entrance/exit hole through which laundry such as clothes or bed clothes are entered or exited, a door opening and closing the entrance/exit hole, and a washing tub rotated by a motor to treat the laundry. The laundry treatment apparatus means an apparatus for performing washing, dehydrating, and drying laundry. Known laundry treatment apparatuses include washers, dehydrators, dryers, etc. Recently, a diversity of multi-functional laundry treatment apparatuses are being developed to perform all of the above functions, and such apparatuses, together with the conventional laundry treatment apparatuses, are collectively referred to as washing machines regardless of the functions they provide.

Hereinafter, as an example of the laundry treatment apparatus, a washing machine is described.

FIG. 4 illustrates a conventional washing machine. FIG. 5 illustrates an example in which a packing material applies to the conventional washing machine. Referring to FIG. 4, a washing machine 1 includes a main body 10 having an entrance/exit hole 12*h* through which objects, such as clothes or bed clothes, to be washed (hereinafter, referred to as "laundry") is entered and exited and a door 16 opening and closing the entrance/exit hole 12*h*. The door 16 may be rotatably coupled with the main body 10.

The main body 10 may include a cabinet 11 with an upper part opened and a top cover 12 coupled with the upper part of the cabinet 11 and having the entrance/exit hole 12*h*. In this case, the door 16 is coupled with the top cover 12.

Inside the cabinet 11 are provided an outer tub 22 containing washing water and an inner tub 24 rotatably provided in the outer tub 22 to contain the laundry put in through the entrance/exit hole 12*h*. The outer tub 22 is hung in the cabinet 11 by way of a supporting member 13, and an end of the supporting member 23 is fixed to the top cover 12, and another end of the supporting member 13 may be coupled with a lower end of the outer tub 22 by way of a suspension 14 mitigating the vibration of the outer tub 22.

The outer tub 22 may include a water storage tank 22*a* containing washing water and a water storage tank cover 22*b* covering the water storage tank and having an opening 22*h* to allow the laundry to be placed at the substantially middle thereof. The inner tub 24 may include a drum 24*a* in which the laundry is accumulated and a balancer 24*b* provided at an upper end of the drum 24*a*. The drum 24*a* includes a plurality of through-holes 24*h* through which washing water passes.

A driver 30 includes a motor 32 generating a rotational force, a rotational shaft 34 rotated by the motor 32, and a clutch (not shown) transferring the rotational force to rotate a pulsator 25. Under the proper control of the clutch, the pulsator 25 may be rotated alone or together with the inner tub 24.

A detergent box 15 contains various additives such as washing detergent, fabric softener for rinsing, and/or bleach, and the detergent box 15 may be disposed in the top cover 12 to be withdrawn. Washing water is supplied from an external water source such as a faucet through a water supply flow path 61 into the detergent box 15, and the washing water, together with the additives, is supplied to the outer tub 22. A water supply valve 62 may be provided to shut on/off the water supply flow path 61.

A water discharge pump 40 is provided on a water discharge flow path 44 communicating with the outer tub 22 to discharge the washing water out of the outer tub 22. A water discharge valve 42 may be further provided to shut on/off the water discharge flow path 44.

The top cover 12 may include a control panel 50 having an input unit (not shown) to receive various control commands on the overall operation of the washing machine and a display unit (not shown) to externally display the operational state of the washing machine and providing a user interface.

Such washing machine needs to have its inner components fixed to prevent damage that may occur due to impacts or shaking during shipping or delivery. In particular, the components, such as the inner tub 24, the outer tub 22, and/or the driver 30 which are suspended in the casing 10, require careful measures to be taken not to be shaken. For such purpose, the manufacturer utilizes a proper packing material to fix the components while in delivery.

Referring to FIG. 5, an upper part fixing packing material 200 for fixing the outer tub 22 at an upper part in the casing 10 and a lower part fixing packing material 300 for fixing the driver 30 at a lower part therein have been conventionally put to use.

The upper part fixing packing material 200 includes a lower end part 210 that is inserted into the inside of the outer tub 22 to inhibit the outer tub 22 from moving in a horizontal direction and an upper end part 220 that, at the outside of the outer tub 22, inhibits the outer tub 22 from moving in a vertical direction.

Since the lower end part 210 should be inserted into the inside of the outer tub 22, the outer diameter of the lower end part 210 should be equal or smaller than the diameter D2 of the opening 22*h* of the water storage tank cover 22*b*.

As such, the upper end part 220 is larger in outer diameter than the lower end part 210, and a step is thus formed, inhibiting the vertical-directional move of the outer tub 22. In this case, the condition that at least a portion of the upper end part 220 should pass through the entrance/exit hole 12*h* of the top cover 12 requires a portion adjacent to the step 221 to have a diameter equal or smaller than D2 and larger than D1.

If the door 16 is closed with the upper part fixing packing material 200 installed, an upper end of the upper end part 220 is pressurized by the door 16, restricting the vertical-directional move thereof. Accordingly, the outer tub 22 is prevented from moving in the vertical direction by the step 221 while in delivery.

The lower part fixing packing material 300 includes a casing support 310 supporting the casing 10 and a driver support 320 projected upward from the casing support 310 to surround and support at least a portion of the driver 30. The lower part fixing packing material 300 restricts a vertical-directional move of the outer tub 22 and/or the inner tub 24 assembled integrally with the driver 30, as well as the driver 30 while also restricting a horizontal-directional move of the same.

Packing using the upper part fixing packing material 200 and the lower part fixing packing material 300 may prevent the outer tub 22 from shaking in the horizontal and vertical directions while in delivery, but such functions are fundamentally limited as applying to the structure in which the diameter D2 of the opening 22*h* of the water storage tank cover 22*b* is smaller than the diameter D1 of the entrance/exit hole 12*h* of the top cover 12 because the step 221 restricting the vertical-directional move of the outer tub 22 should be fixed to the outside of the outer tub 22 without being inserted into the inside of the outer tub 22 and thus the entrance/exit hole 12 should have a size large enough to permit the passing of the step 221 whereas the opening 22*h* should have a size in which the step 221 cannot pass therethrough.

However, there is an effort to increase the volume of the outer tub 22 for an increased capacity. In the case of large-size washing machines, the opening 22*h* of the outer tub 22 has a larger diameter than that of the entrance/exit hole 12*h* of the casing 10. Accordingly, a need exists for a packing material for such state-of-art washing machines, which may fasten the outer tub 22 and all other components thereof to prevent a shake during delivery.

SUMMARY OF THE INVENTION

An object of the present invention is to provide a packing material for a laundry treatment apparatus, which may prevent the outer tub and other components integrally formed with the outer tub from shaking while the laundry treatment apparatus is being delivered. The packing material according to the present invention may also apply to a laundry treatment apparatus having an outer tub whose opening is larger in diameter than the entrance/exit hole of its casing.

According to the present invention, there is provided a packing material for a laundry treatment apparatus having a casing with an entrance/exit hole through which laundry is entered and exited and an outer tub hung in the casing and having an opening through which the laundry is entered and exited, the packing material including a base part at a side of a predetermined fold line corresponding to the shape of the opening and a gap compensating part at another side of the fold line, wherein the base part is inserted into a space between the outer tub and an entrance/exit hole forming part forming the entrance/exit hole in the casing, and wherein the gap compensating part is inserted into an inside of the outer tub when the packing material is folded along the fold line.

According to the present invention, the packing material for laundry treatment apparatus may prevent the outer tub from shaking while the laundry treatment apparatus is in delivery even when the diameter of the opening of the outer tub is equal or larger than the diameter of the entrance/exit hole of the casing.

Further, according to the present invention, the pm for laundry treatment apparatus may compensate for a gap that may be caused by changing the structure for increased capacity, thus allowing for use of the conventional packing materials. This contributes to the parts being commonly used.

BRIEF DESCRIPTION OF THE DRAWINGS

The above and other objects, features and other advantages of the present invention will be more clearly understood from the following detailed description taken in conjunction with the accompanying drawings, in which:

FIG. 2A is a cross-sectional view illustrating a laundry treatment apparatus to which the packing material illustrated in FIG. 1 applies, and FIG. 2B is an expanded view illustrating a portion of FIG. 2A, as denoted in dashed lines;

FIG. 3A is a cross-sectional view illustrating the laundry treatment apparatus of FIG. 2, to which an upper part fixing packing material further applies, and FIG. 3B is an expanded view illustrating a portion of FIG. 3A, as denoted in dashed lines;

FIG. 5A is a cross-sectional view illustrating the laundry treatment apparatus of FIG. 4, which has been packed according to the conventional art, and FIG. 5B is an expanded view illustrating a portion of FIG. 5A, as denoted in dashed lines;

DETAILED DESCRIPTION OF THE PREFERRED EMBODIMENTS

Advantages and features of the present invention and a method of achieving the same will be more clearly understood from embodiments described below with reference to the accompanying drawings. However, the present invention is not limited to the following embodiments but may be implemented in various different forms. The embodiments are provided merely to complete disclosure of the present invention and to fully provide a person having ordinary skill in the art to which the present invention pertains with the category of the invention. The invention is defined only by the category of the claims. Wherever possible, the same reference numbers will be used throughout the specification to refer to the same or like parts.

Hereinafter, a washing machine, a sort of laundry treatment apparatus, is exemplified in describing the present invention. However, it should be noted that this is merely for ease of description and the present invention should not be limited thereto.

Figure 1:
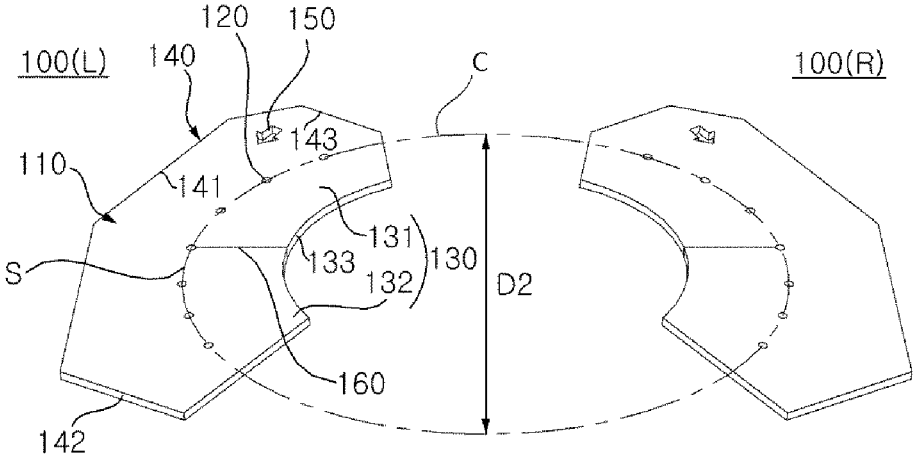
FIG. 1 illustrates a packing material for a laundry treatment apparatus according to an embodiment of the present invention.
Figure 4:
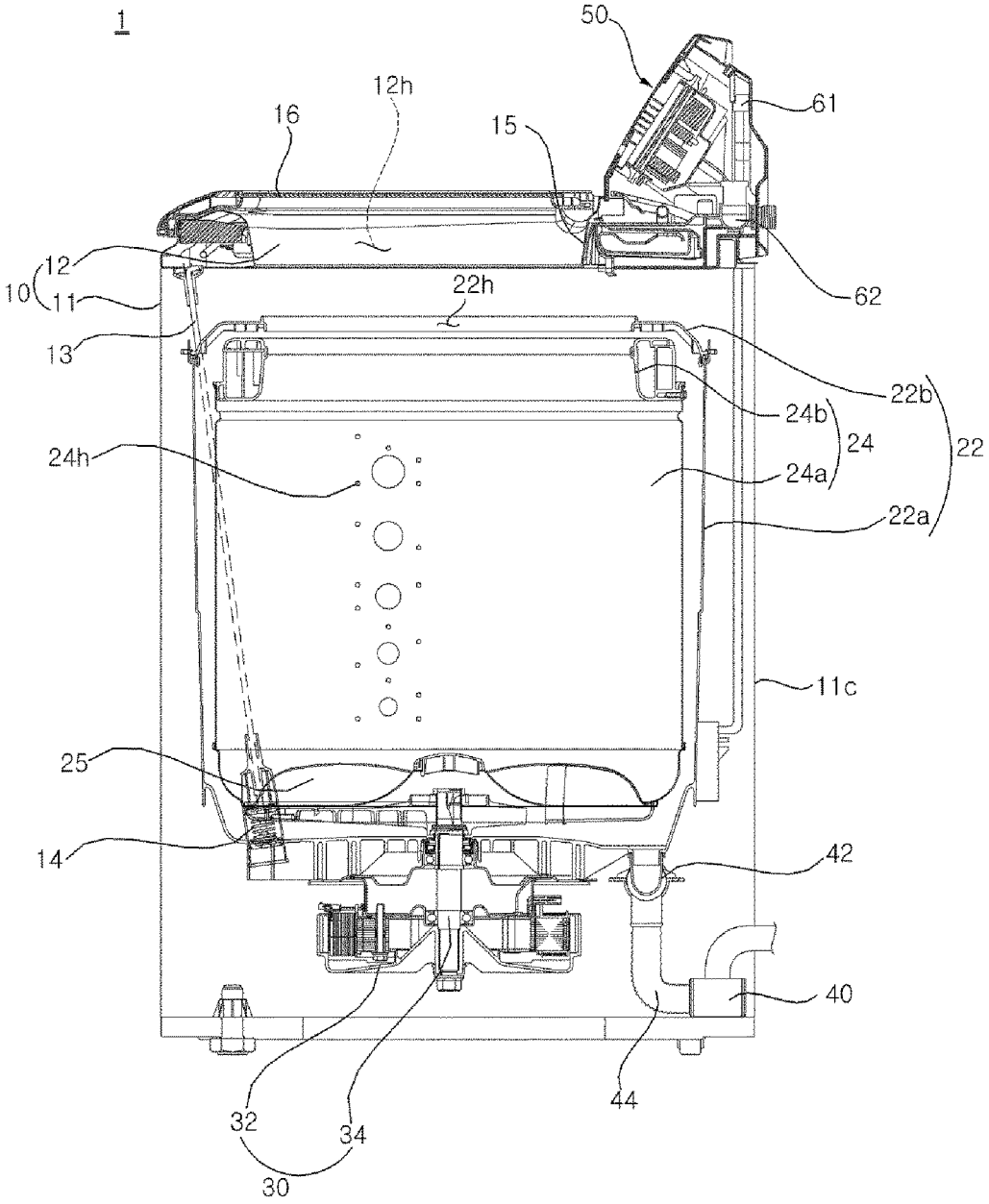
FIG. 4 is a cross-sectional view illustrating a conventional washing machine.

FIG. 1 illustrates a packing material for a laundry treatment apparatus according to an embodiment of the present invention. FIG. 2A is a cross-sectional view illustrating a laundry treatment apparatus to which the packing material illustrated in FIG. 1 applies, and FIG. 2B is an expanded view illustrating a portion of FIG. 2A, as denoted in dashed lines.

Referring to FIGS. 1, 2, 4, and 5, according to an embodiment of the present invention, a packing material 100 for a laundry treatment apparatus is a plate-type material that is formed of a material that may be folded by an external force. The packing material 100 includes a base part 110 at a side of a predetermined fold line S corresponding to the shape of the opening 22*h* of the outer tub 22 and a gap compensating part 130 at the other side of the fold line S. The base part 110 is inserted into a space between the outer tub 22 and an entrance/exit hole forming part 12 forming an entrance/exit hole 12*h* through which laundry is entered and exited. The gap compensating part 130 is inserted into the inside of the outer tub 22 when the packing material 100 is folded along the fold line S.

Two or more packing materials 100 may apply to a single washing machine. FIGS. 1 and 2 show an example in which a left-side packing material 100L and a right-side packing material 100R apply. The denotations "L" and "R" are simply used to distinguish two packing materials 100 from each other, and thus, either the left-side packing material or the right-side packing material is collectively referred to as the packing material 100 unless required otherwise.

Further, the above-described conventional upper part fixing packing material 200 and the lower part fixing packing material 300 are present as packing materials for washing machine. Accordingly, to distinguish the above-conventional types of packing materials from the ones according to the present invention, the packing material 100 according to the present invention is referred to as a gap compensating packing material 100. However, this is done so merely to avoid any confusion in description, and it should be appreciated that the present invention is not limited thereby or thereto and that the scope of the present invention should be interpreted by the appended claims.

The entrance/exit hole forming part 12 may be a portion of the casing 10 and may be defined as a portion to form the entrance/exit hole 12*h*. In the instant embodiment, a top cover 12 is exemplified that is separately formed from the cabinet 11. However, the present invention should not be limited thereto. For example, in case the casing 10 is configured so that the cabinet 11 and the top cover 12 are integrally formed with each other, a portion of the casing 10, which has an opening for entrance/exist of the laundry, may be defined as the entrance/exit hole forming part 12.

An edge 140 of the base part 110, which is opposite the cabinet 11, may have any shape without limited to a particular shape. Also in such case, the edge 140 may be divided depending on facing directions into a side section 141 facing a side part 11*a* of an inner surface of the cabinet 11, a front section 142 facing a front part 11*b* of the cabinet 11, and a rear section 143 facing a rear part 11*c* of the cabinet 11. Preferably, the side section 141, the front section 142, and/or the rear section 143 contact their respective opposite side part 11*a*, front part 11*b*, and/or rear part 11*c* inside the cabinet 11.

The fold line S has a shape corresponding to the shape of the opening 22*h*. In a typical washing machine, the opening 22*h* is shaped as a circle C, and thus, the fold line S is hereinafter shaped as a circular arc, for example. The fold line S may be a real-life line that has been printed on the surface of the gap compensating packing material 100 or processed as a groove, but should not be limited thereto. In other words, any element may serve as the fold line S as long as it may functionally or structurally distinguish the base part 110 from the gap compensating part 130. Accordingly, a conceptual or virtual line, not a real-life mark formed on the surface of the gap compensating packing material 100, may be defined as the fold line S.

The gap compensating part 130 has a linear cut 160 formed from the fold line S up to an internal edge 133 oriented toward the center of the outer tub 22. Multiple linear cuts 160 may be formed. Free ends are provided at both parts 131 and 132 of the linear cut 160, thus allowing the parts to be smoothly folded without interfering with each other.

Multiple folding guide marks 120 may be formed along the fold line S. The folding guide marks 120 may include dots or lines printed along the fold line S. Preferably, the folding guide marks 120 may be perforations formed to be spaced apart from each other along the fold line S. In case the folding guide marks 120 are formed by printing, the printed surface may be brought in contact with other components of the washing machine, thus causing an ink transfer to the other components. However, in case the folding guide marks 120 are formed as holes, such ink transfer and resultant contamination may be prevented. Further, the folding guide marks 120 may be flipped to allow for use of either the left-side packing material 100L and the right-side packing material 100R.

The gap compensating packing material 100 should be easily folded by an external force and is preferably formed to have a predetermined degree of compression or elasticity to absorb shock. Such material includes, but is not limited to, e.g., a foam resin, in particular, foam polyethylene (PE).

The gap compensating packing material 100 may further include an installation direction mark 150. The installation direction mark 150 indicates a direction in which the gap compensating packing material 100 is installed, through a symbol, a letter, or a diagram. In this embodiment, the installation direction mark 150 is a mark shown like an arrow that points to the front side of the washing machine. A worker may apply the gap compensating packing material 100 by positioning the gap compensating packing material 100 so that the arrow points to the front side of the washing machine, pushing the base part 110 into a space between the top cover 12 and the water storage tank cover 22*b*, and folding the gap compensating part 130 along the folding guide marks 120.

FIG. 3A is a cross-sectional view illustrating the laundry treatment apparatus of FIG. 2, to which an upper part fixing packing material further applies, and FIG. 3B is an expanded view illustrating a portion of FIG. 3A, as denoted in dashed lines. Referring to FIG. 3, after the gap compensating packing material 100 has been completely applied, the upper part fixing packing material 200 may further apply.

Even when the diameter D2 of the opening 22*h* of the outer tub 22 is equal or larger than the diameter D1 of the entrance/exit hole 12*h* of the top cover 12, the gap compensating packing material 100 fills the inside of the opening 22*h*, in particular, as much as the thickness D of the gap compensating part 130, and the base part 110 supports the step 221, at least, as much as the thickness. Accordingly, even when the outer diameter of the lower end part 210 of the upper part fixing packing material 200 is equal to D2 or even smaller than D2, the upper part fixing packing material 200 may apply. The outer tub 22 may be prevented from shaking in the horizontal direction, and the step 221 may be supported by the gap compensating packing material 100 to prevent the outer tub 22 from shaking in the vertical direction.

Further, the gap compensating packing material 100 that has a proper thickness depending on the capacity of the outer tub 22 may be used to compensate for a gap that is caused by a difference in diameter between the opening 22*h* of the outer tub 22 and the entrance/exit hole 12*h* of the top cover 12. Accordingly, the common upper part fixing packing material 200 may apply to various types of washing machines having different capacities of outer tubs 22.

The lower part fixing packing material 300 may also apply, and the same description given above in connection with FIGS. 5 and 6 may apply, and detailed description of such example is skipped.

It should be appreciated by one of ordinary skill in the art that the present invention may be practiced in other specific forms without changing the technical spirit or essential features thereof. Hence, it should be appreciated that the above-described embodiments are given for example and should not be understood as limited thereto. The scope of the present invention is defined by the following claims rather than the detailed description and that all the modifications or variations induced from the meaning and concept and equivalents of the present invention are included in the scope of the present invention.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A laundry treatment apparatus shipping package comprising:

a laundry treatment apparatus comprising:

a casing with a hole, and an outer tub included in the casing, the outer tub having an opening that is larger than the hole in the casing, the opening through which laundry inserted through the hole in the casing is placed into the outer tub and through which laundry is retrieved from the outer tub through the hole in the casing;

a first packing material on which multiple perforations are formed along a predetermined virtual fold line configured to have a shape corresponding to a shape of the opening in the outer tub and spaced apart from each other, the first packing material folded at the fold line, the first packing material comprising:

a base part that is defined at a first side of the fold line, and a gap compensating part defined at a second side of the fold line that is opposite of the first side of the fold line;

wherein, based on the first packing material being folded along the fold line:

the base part is inserted into a space between the outer tub and a part of the casing that defines the hole in the casing, and the gap compensating part is inserted into an inside of the outer tub, and a second packing material comprising:

an upper end part that is inserted into the hole in the casing and placed on the base part of the first packing material; and a lower end part that is configured to extrude from a bottom of the upper end part, that is configured to be inserted into the opening of the outer tub, and that is configured to contact the gap compensating part.

2. The laundry treatment apparatus shipping package of claim 1, wherein the gap compensating part includes a linear cut that extends from the fold line to an internal edge oriented toward a center of the outer tub.

3. The laundry treatment apparatus shipping package of claim 1, wherein the gap compensating part is configured to fill an inside of the opening to a distance corresponding to a thickness of the gap compensating part.

4. The laundry treatment apparatus shipping package of claim 1, wherein an edge of the base part that is configured to face the casing includes a section configured to contact an inner surface of the casing.

5. The laundry treatment apparatus shipping package of claim 1, wherein the fold line is configured to be shaped as a circular arc.

6. The laundry treatment apparatus shipping package of claim 1, wherein the first packing material further comprises an installation direction mark that indicates an orientation of the first packing material appropriate for installing the first packing material in the laundry treatment apparatus.

7. The laundry treatment apparatus shipping package of claim 1, wherein the first packing material is made of a material that is configured to bend in any direction when an external force is applied.

8. The laundry treatment apparatus shipping package of claim 1, wherein the first packing material is made of foam polyethylene.

9. The laundry treatment apparatus shipping package of claim 1, wherein the first packing material is made of a single material.

10. The laundry treatment apparatus shipping package of claim 1, wherein the first packing material is formed as a thin planer shape.

11. The laundry treatment apparatus shipping package of claim 1, wherein the first packing material is configured to be placed at one side of the laundry treating apparatus and used with another first packing material placed at another side of the laundry treating apparatus.

12. The laundry treatment apparatus shipping package of claim 1, wherein an edge of the base part, which is configured to be placed opposite of the casing, is divided into a side section configured to face a side part of an inner surface of the casing, a front section configured to face a front part of the casing, and a rear section configured to face a rear part of the casing.

13. The laundry treatment apparatus shipping package of claim 12, wherein the side section, the front section, and the rear section are configured to contact their respective opposite side part, front part, and rear part inside the casing.

14. The laundry treatment apparatus shipping package of claim 1, wherein the first packing material is configured to be inserted into the laundry treatment apparatus by pushing the base part into a space between a top cover of the laundry treatment apparatus and a water storage tank cover of the laundry treatment apparatus, and folding the gap compensating part along folding guide marks defined along the fold line.

* * * * *